US007367356B2

(12) United States Patent
Berndorfer

(10) Patent No.: US 7,367,356 B2
(45) Date of Patent: May 6, 2008

(54) OIL FLOW CONTROL VALVE FOR A CAM PHASER

(75) Inventor: Axel H Berndorfer, Nittel (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/483,787

(22) Filed: Jul. 10, 2006

(65) Prior Publication Data

US 2007/0062586 A1 Mar. 22, 2007

(30) Foreign Application Priority Data

Sep. 22, 2005 (EP) ..... 05020661

(51) Int. Cl.
*F16K 1/30* (2006.01)
*F16K 11/07* (2006.01)

(52) U.S. Cl. ..... 137/614.2; 137/533.19; 137/540

(58) Field of Classification Search ..... 137/614.2, 137/533.13, 533.19, 539, 540, 543.19, 533.11
See application file for complete search history.

(56) References Cited

U.S. PATENT DOCUMENTS 4,520,908 A * 6/1985 Carpenter ..... 137/614.2
4,874,066 A * 10/1989 Silberstein ..... 137/538

FOREIGN PATENT DOCUMENTS

EP 1767749 A1 * 3/2007

* cited by examiner

*Primary Examiner*—Kevin Lee
(74) *Attorney, Agent, or Firm*—Paul L. Marshall

(57) ABSTRACT

An oil flow control valve (10) for a cam phaser is described comprising a spool (18), a spool housing (16) and a check valve (40), wherein the spool (18) comprises a throughbore (60) and the check valve (40) is mounted in the spool housing (16) in that it extends through the throughbore (60) allowing the check valve (40) to be integrated in the housing (16) of the oil flow control valve (10), with the spool (18) reciprocally moving around the check valve (40), in order to avoid any influencing of the equilibrium of a spool (18) when the oil pressure is suddenly changing in the oil flow control valve (10) due to varying efforts in the cam phaser caused by the valve train.

9 Claims, 5 Drawing Sheets

OIL FLOW CONTROL VALVE FOR A CAM PHASER

TECHNICAL FIELD

The present invention generally relates to an oil flow control valve for a cam phaser.

BACKGROUND OF THE INVENTION

Cam phasers are used to control the angular relationship of the pulley/sprocket to the camshaft of an engine. A variable cam phaser (VCP) allows changing the phase relationship while the engine is running. Typically, a cam phaser is used to shift the intake cam on a dual overhead cam engine in order to broaden the torque curve of the engine, to increase peak power at high rpm, and to improve the idle quality. Also, the exhaust cam can be shifted by a cam phaser in order to provide internal charge diluent control, which can significantly reduce HC and NOx emissions, or to improve fuel economy.

Cam phasers are controlled by hydraulic systems, which use pressurized lubrication oil from the engine in order to change the relative position between camshaft and crankshaft, thus altering the valve timing. The advance or retard position of the camshaft is commanded via an oil flow control valve. The oil flow control valve (OCV in the following) controls the oil flow to different ports entering a cam phaser, thus controlling the angular position of the camshaft relative to pulley or sprocket. However, the pressure of the oil contained in the chambers of the cam phaser is affected by the motion of the valve train such that the oil pressure inside the cam phaser reaches peaks, which can be higher than the oil control supply pressure, i.e., the oil pressure supplied by the engine. This can lead to a certain amount of reverse oil flow across the OCV, diminishing the phase rate performance of the cam phasing system.

To avoid the reverse oil flow under the above mentioned circumstances, a check valve has been integrated in the oil passage of either the cylinder head or the crankcase. Such a check valve also ensures that the cam phaser does not empty out in cases when the oil pressure is reduced, for example when the engine is stopped. However, this approach adds significant cost to the cylinder head or engine block. Also, the implementation of the check valve can be difficult because of oil routing. Furthermore, the check valve should not be placed too far away from the cam phaser in order to be still effective.

It is known from U.S. Pat. No. 5,291,860 or EP 1 447 602 to integrate a check valve into the OCV.

In U.S. Pat. No. 5,291,860 the check valve is integrated into the spool of the OCV. In EP 1 447 602 the check valve is integrated into the side walls of the housing of the OCV. The check valve is a spring blade having a cylinder portion shape. When the pressure in the oil channel leading to the check valve is higher than the spring force of the spring blade, oil can enter the OCV. If, on the other hand, the oil pressure in the OCV reaches a pressure higher than the pressure in the relevant oil channel, the oil in the OCV will tend to push against the inner side of the spring blade which will be forced into a closed position thereby preventing the return flow of oil in the oil channel.

SUMMARY OF THE INVENTION

The object of the present invention is to provide an improved embodiment of such oil control valves. This object is achieved by an OCV for a cam phaser as claimed in claim 1. The oil flow control valve for a cam phaser comprising a spool, a spool housing and a check valve, according to the invention, is characterised in that the spool comprises a throughbore and the check valve is mounted in the spool housing in that it extends through the throughbore.

One basic idea underlying the invention is essentially based on the discovery that the check valve on the spool of the OCV known from U.S. Pat. No. 5,291,860 can perturb the equilibrium of the spool, since the pressure balance of the spool is completely disturbed under certain operating conditions. An increasing oil pressure on the check valve generates forces acting on the spool and forcing the spool in one direction. However, this can influence the oil pressure in the cam phaser and, thus, the precision of the adjustment of the cam phaser. Furthermore, it can diminish the cam phaser's performance.

Thus, according to the invention, the check valve is integrated in the housing of the OCV in order to avoid any influencing of the equilibrium of a spool of the OCV when the oil pressure is suddenly changing in the OCV due to varying efforts in the cam phaser caused by the valve train. The invention enables a better control of the OCV and hence of the cam phaser. This improves the engine behaviour in that more precise valve control times can be achieved. Furthermore, check valves integral to the OCV allow for easier cylinder head machining and improved serviceability.

A further advantage of the invention is that the closer the check valve is placed to the pressurized chambers of the cam phaser, the less oil volume is comprised between the chambers and the check valve. Therefore, the volume of oil pressurized by the cam phaser is low and, thus, no or less damping exists which enhances the valve control precision. Since the spool does not contain the check valve, it is lighter than the spool of the OCV described in U.S. Pat. No. 5,291,860. Accordingly, the inertia of the spool in the OCV according to the invention is small, and therefore, the spool can react faster than a spool with an integrated check valve. Furthermore, the throughbore in the spool further reduces the spool's mass and its inertia.

The dependent claims outline advantageous forms of embodiment of the apparatus according to the invention.

Preferably, the check valve in the oil flow control valve comprises an elongated cage and a spring biased ball contained in the cage. The spring biased ball then functions as a means for preventing oil from flowing back into the oil channel.

Further preferably, the cage of the check valve is located near a middle portion of the spool with the main axis of the cage and the main axis of the spool oriented perpendicular. Thus, the direction of force of the biasing spring and the direction of movement of the spool are oriented perpendicular also. The direction of force of the biasing spring is parallel to a middle axis of the oil channel leading into the oil flow control valve.

In accord with the present invention, the throughbore is of elongated curved or circular shape allowing reciprocating movement of the spool in the housing.

In further accord with the present invention, the oil flow control valve is fed from the side and the check valve is placed near the relevant inlet, more specifically the inlet of an oil supply channel, of the oil flow control valve. More particularly, the check valve is placed opposite the relevant inlet of the oil flow control valve, thus the central axis of the relevant inlet or the relevant oil channel and the main axis of the check valve coincide, or are at least, essentially coinciding.

In further accord with the invention, the cage of the check valve comprises at least one opening provided in order to allow oil to pass from inside the cage into the throughbore and from there, depending on the position of the spool, into subsequent chambers of the cam phaser.

In an alternative embodiment of the invention the check valve comprises of two biasing springs and two balls spring-biased by said two biasing springs. Thus, the check valve according to the alternative embodiment essentially is a combination of two check valves of the embodiment described above. Such a check valve is beneficial when the oil flow control valve is fed from via two side inlets.

According to another alternative embodiment, the main axis of the housing and the main axis of the spool are parallel wherein the spool is disposed non-centrally in the housing. Thus, the cross section of the housing is partially sickle-shaped with the widest part of such a sickle preferably located in an area where the check valve is fixedly mounted into the housing. The increased wall size of the housing in the above sickle-shaped portion allows for an improved fixing of the check valve in the housing.

Other features and advantages of the present invention will appear from the following description of a preferred embodiment of the invention, given as a non-limiting example, illustrated in the drawings. All the elements which are not required for the immediate understanding of the invention are omitted. In the drawing, the same elements are provided with the same reference numerals in the various figures, and in which:

DETAILED DESCRIPTION OF THE INVENTION

Preferred embodiments of an oil flow control valve (OCV) for a cam phaser in accordance with the invention will now be described.

In the following description, for purposes of explanation and not limitation, specific details are set forth, such as particular embodiments, techniques, etc. in order to provide a thorough understanding of the present invention. However, it will be apparent to one skilled in the art that the present invention may be practiced in other embodiments that depart from these specific details.

In other instances, detailed descriptions of well-known methods are omitted so as not to obscure the description of the present invention with unnecessary detail.

Figure 1:
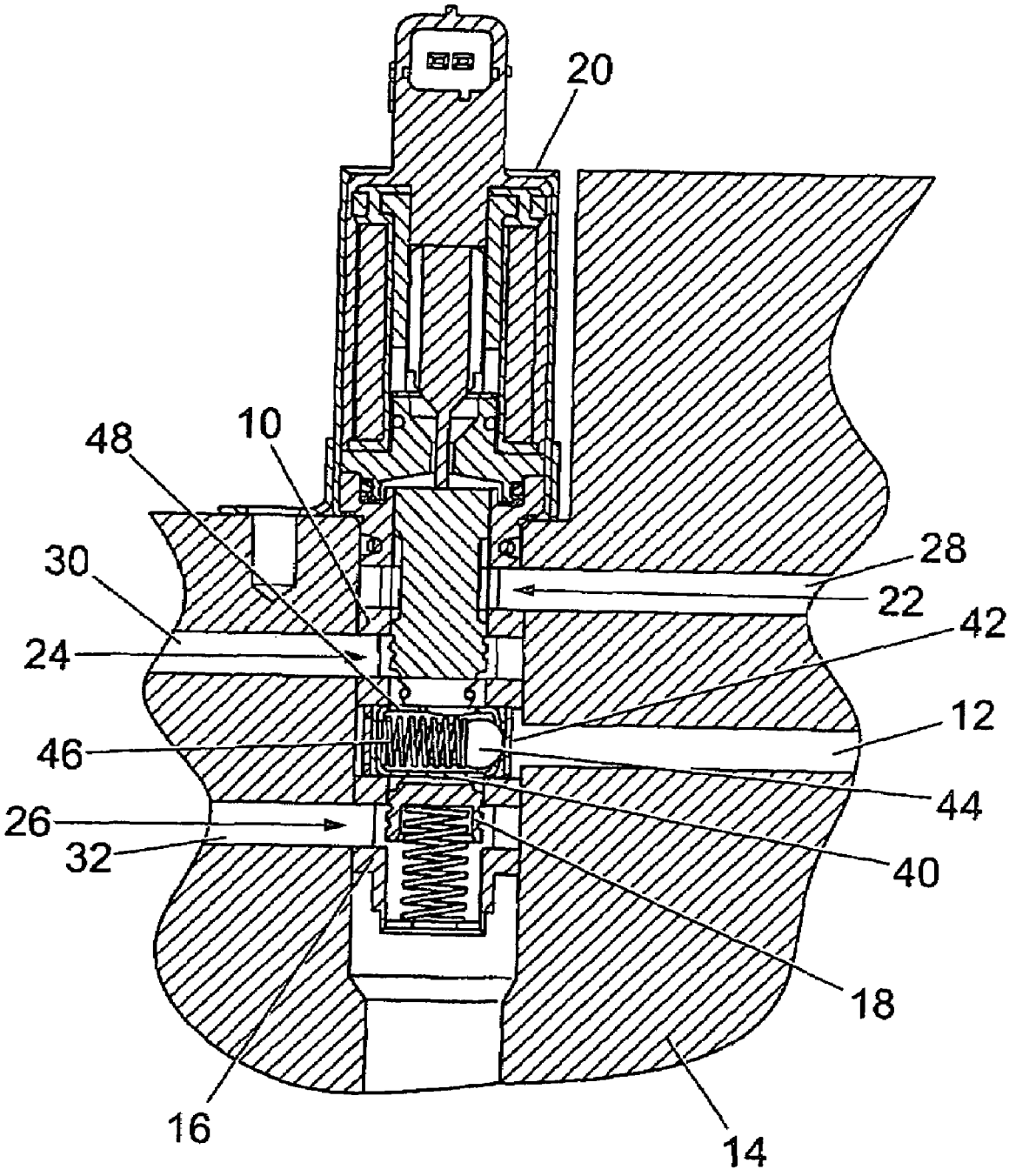
FIG. 1 is a longitudinal section through an OCV according to the invention with a check valve mounted in the spool housing in that it extends through a throughbore in the spool.

FIG. 1 shows an OCV 10 for controlling the oil flow from an oil supply channel 12 into a cam phaser of an internal combustion engine. The OCV 10 is generally mounted in a bore in the engine cylinder head 14. The OCV 10 comprises a housing 16, a spool 18 located in the housing 16, and a control unit 20 for controlling the position of the spool 18 in the housing 16.

The housing 16 of the OCV 10 is formed like a sleeve comprising openings 22, 24, and 26 which cooperate with oil channels 28, 30 and 32 arranged in the cylinder head 14.

The oil flow through the OCV 10 and the channels 28, 30 and 32 is essentially controlled by the position of the spool 18 which is reciprocally mounted in the housing 16, as is well known in the art. The placement of the spool 18 in the housing 16 is controlled by the control unit 20, which preferably includes a solenoid actuator.

In the OCV, a check valve 40 is associated with the housing 16. The check valve 40 may thus be designed as an integral part of the housing 16, but may alternatively be directly or indirectly fixed to the housing 16. The structure and operation of this check valve 40 will be described in more detail in connection with the subsequent figures.

In the embodiment of FIG. 1, the oil supply channel 12, through which the OCV 10 receives pressurised oil from the engine, and distributes/receives oil to/from channels 28, 30 and 32 for controlling the oil supply to the cam phaser, is placed in the middle part of the housing 16 and terminates in an antechamber 42 formed by an opening in the housing 16.

In the present embodiment, oil from the engine enters the antechamber 42 under high pressure. If the antechamber 42 is filled with oil, the oil enters the OCV via the check valve 40, which contains a spring biased ball 44, a biasing spring 46 and a cage 48, more particularly an elongate cage 48, containing the biasing spring 46 and the ball 44. Both the oil pressure inside the spool 18 and the forces of this biasing spring 46 press the ball 44 against an inlet passage 50 (cf. FIG. 3), essentially a hole, formed in the cage 48.

The check valve 40 opens if the oil pressure in the antechamber 42 exceeds the forces of the biasing spring 46 and/or the oil pressure inside the spool 18. On the other hand, if the oil pressure inside the spool 18 and/or the forces of the biasing spring 46 exceed the oil pressure in the antechamber 42, e.g. if the oil pressure from the engine diminishes, the ball 44 is pressed against the inlet passage 50 and closes the check valve 40.

Figure 2:
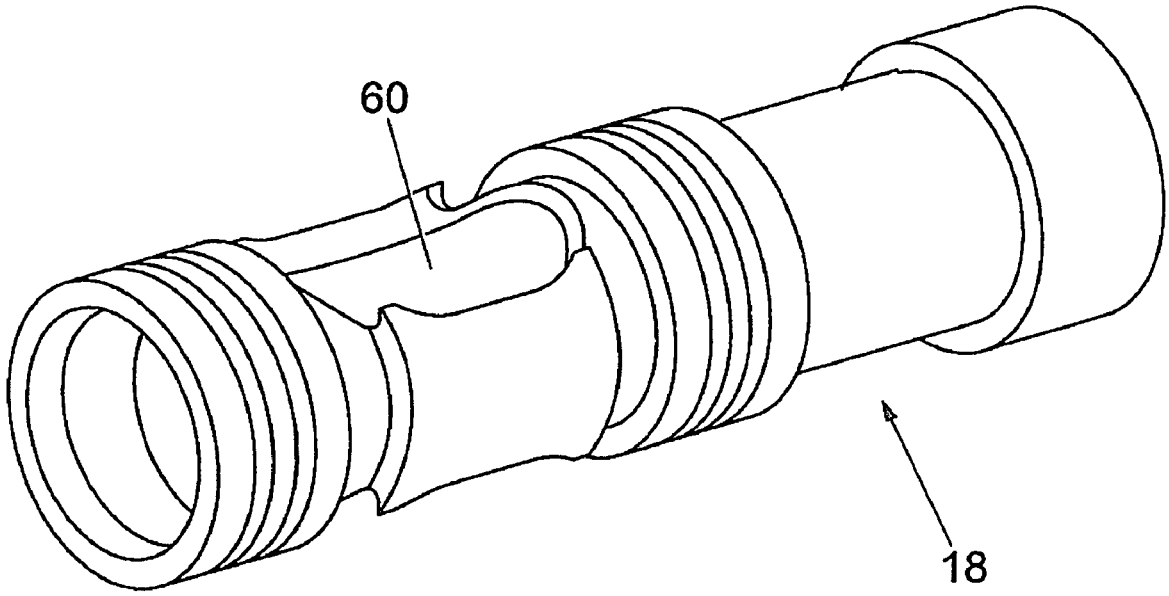
FIG. 2 is a side view of the spool with its throughbore.

FIG. 2 is a side view of the spool 18. As can be seen from FIG. 2 the spool 18 comprises a throughbore 60.

Figure 3:
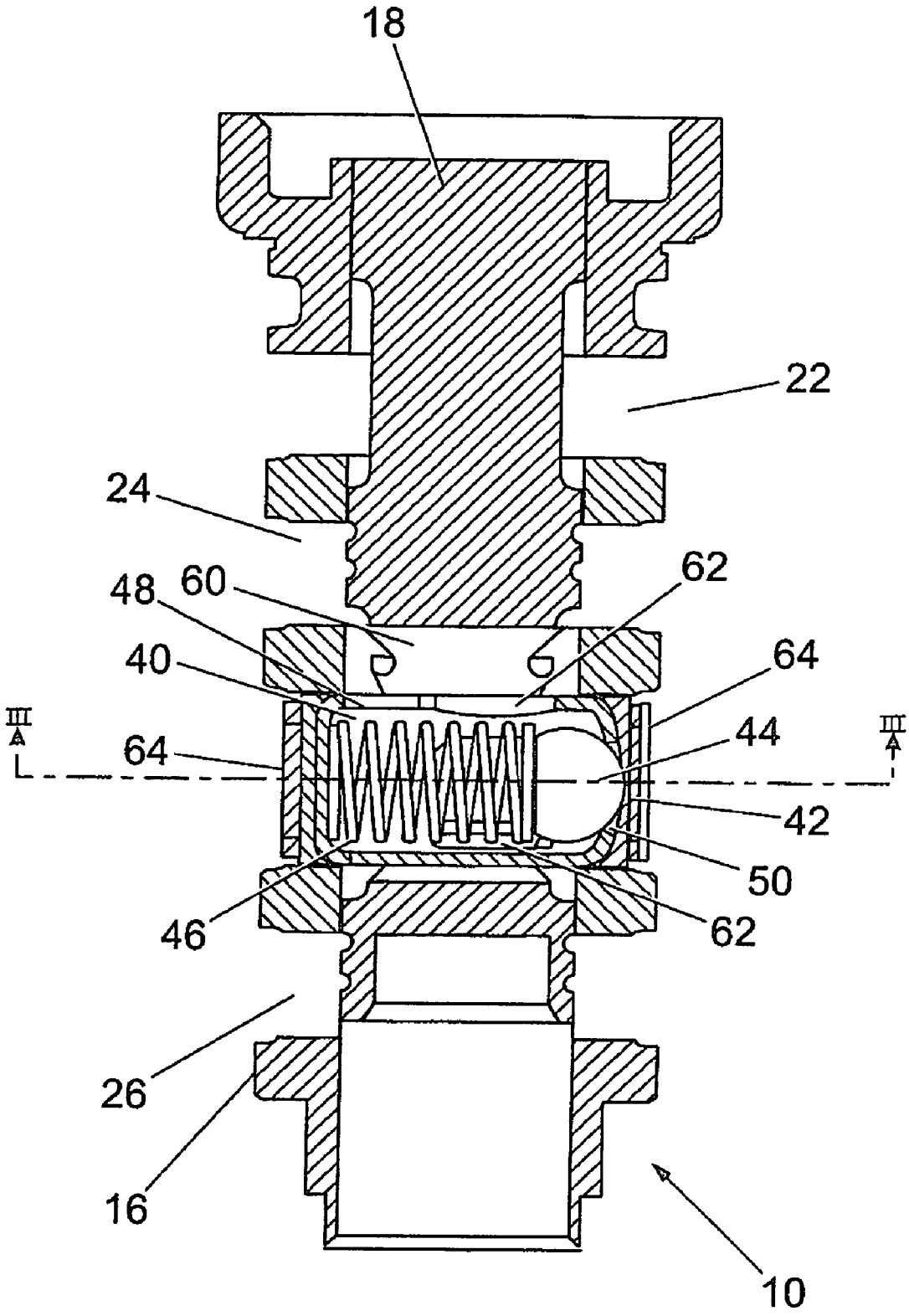
FIG. 3 is a schematic longitudinal section the OCV of FIG. 1.

FIG. 3 is a longitudinal section through the spool 18 and its housing 16 along the main axis of the spool 18. As can be seen from FIG. 3 the check valve 40 is mounted in the spool housing 16 in that it extends through the throughbore 60 in the spool 18. As specifically depicted in FIG. 3 the check valve 40 comprises the cage 48 containing the biasing spring 46 and the spring biased ball 44. According to the situation depicted in FIG. 3 the inlet passage 50 is blocked by the spring biased ball 44 in that the biasing spring 46 holds the ball 44 in the position where the inlet passage 50 is blocked. Once the oil pressure from the oil supply channel 12 or in the antechamber 42 increases in as much as it exceeds the spring force of the biasing spring 46 and/or the oil pressure inside the spool 18, the inlet passage 50 opens.

As will be apparent from FIG. 2 the throughbore 60 is of elongated circular shape allowing reciprocating movement of the spool 18 in the housing 16.

The cage 48 comprises at least one opening 62 provided in order to allow oil to pass from inside the cage 48 into the throughbore 60 and from there via openings 22, 24, 26 into subsequent oil channels 28, 30, 32 functioning as oil ports of the cam phaser.

The antechamber 42 comprises a filter 64 which is disposed circumferentially around the housing 16 in the area of the antechamber 42. The filter 64 provides a means for preventing particulate material from entering the OCV 10.

Since the check valve 40 is fixedly mounted to the housing 16, any forces acting on the check valve 40 caused by pressure peaks in the cam phaser, particularly due to the valve train, do not influence the position of the spool 18 in the housing 16.

Figure 4:
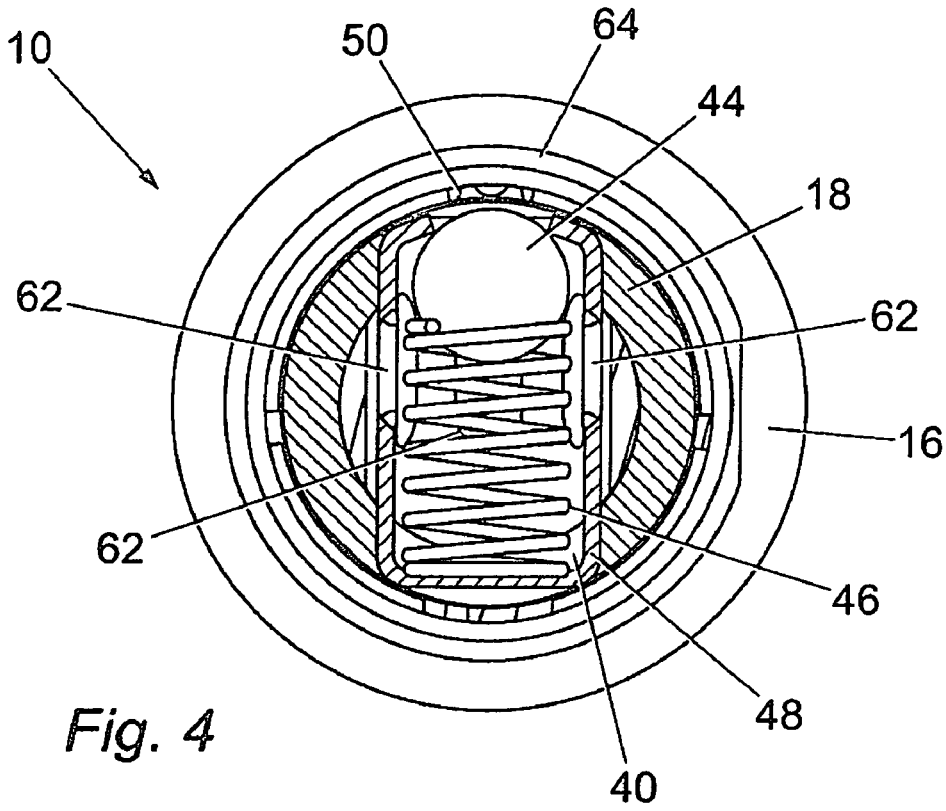
FIG. 4 is a schematic cross-sectional view through the OCV of FIG. 3, FIGS. 5, 6, and 7 are schematic cross-sectional views of alternative embodiments of the OCV in FIG. 3/FIG. 4.

FIG. 4 is a schematic cross-sectional view through the OCV of FIG. 3 along section line III-III and shows the cage 48 of the check valve 40 and the spring biased ball 44 as well as the biasing spring 46. Also in FIG. 4 the at least one opening 62 in the cage 48, allowing oil to pass from the check valve 40 into the throughbore 60 and from there, depending on the vertical position of the spool into subsequent oil channels 28, 30, 32 is apparent. In the embodiment of FIG. 4 the cage 48 comprises four openings 60 with only three openings visible due to the cross section through the centre of the cage 48.

Figure 5:
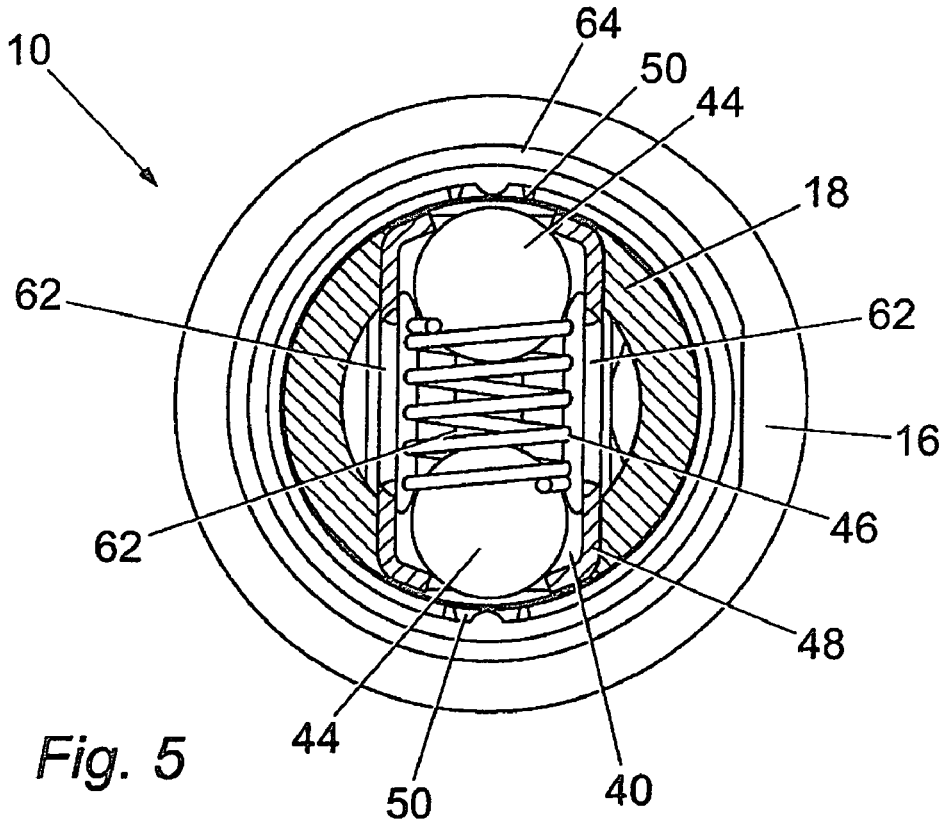

FIG. 5 is a schematic cross-sectional view of an alternative embodiment of the OCV in FIG. 3 or FIG. 4. The OCV 10 according to the alternative embodiment comprises a cage 48 with two spring biased balls 44 and two biasing springs 46, respectively. The functionality is essentially identical to what was described hereinabove apart from this alternative OCV 10 being provided for receiving oil for the oil supply channel 12 from two sides.

Figure 6:
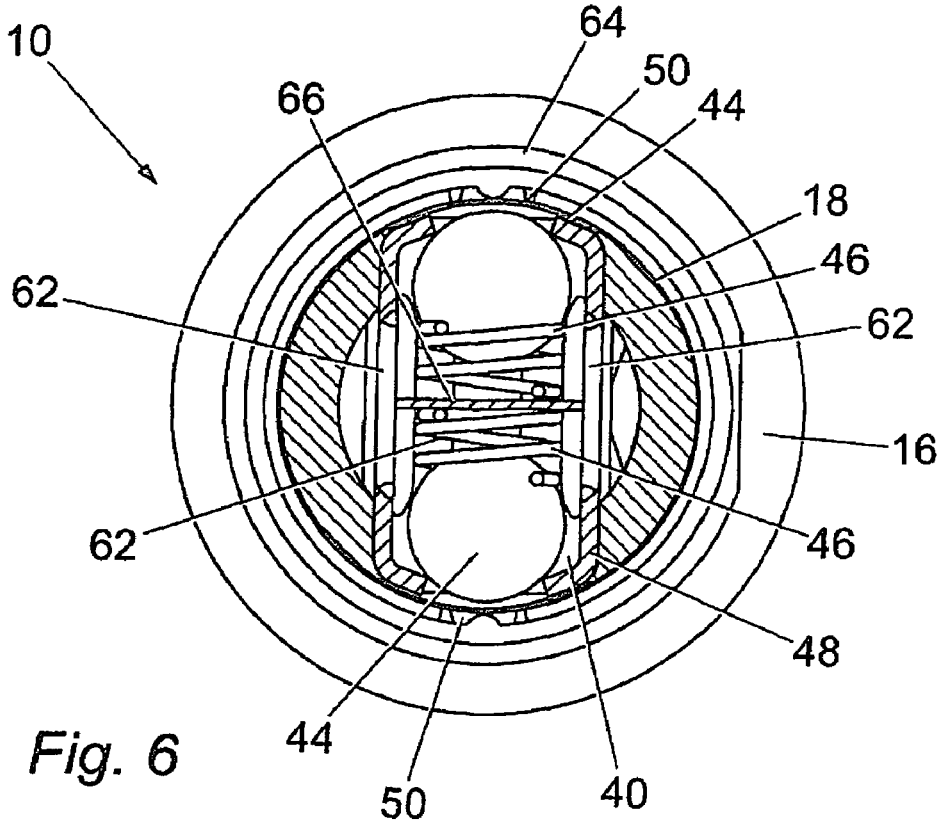

FIG. 6 is a schematic cross-sectional view of an alternative embodiment of the OCV in FIG. 5. The OCV 10 according to the alternative embodiment comprises two biasing springs 46 separated by a divider 66 which is inserted into the cage 48 or integrally formed with the cage 48. The functionality is essentially identical to what was described hereinabove apart from this alternative OCV 10 being provided for receiving oil for the oil supply channel 12 from two sides with the possibility for each of the springs reacting independently on the balance of the inner and outer oil pressure.

Figure 7:
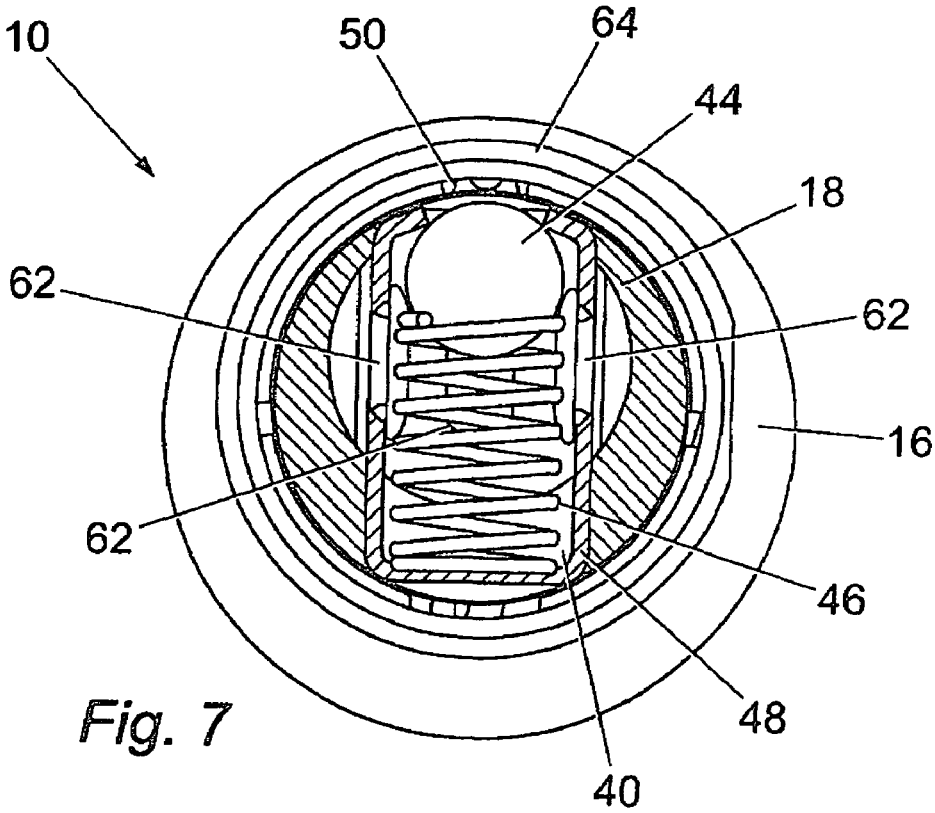

FIG. 7 is a schematic cross-sectional view of another alternative embodiment of the OCV in FIG. 3 or FIG. 4. With the OCV 10 according to this alternative embodiment the main axis of the housing 16 and the main axis of the spool 18 are parallel, wherein the spool 18 is disposed non-centrally in the housing 16. Thus, the cross section of the housing 16 is partially sickle-shaped with the widest part of such a sickle preferably located in an area where the check valve 40 is fixedly mounted into the housing 16. The increased wall size of the housing 16 in the above sickle-shaped portion allows for an improved fixing of the check 40 valve in the housing 16.

Although in the above description preferred embodiments of the OCV 10 according to the invention were explained, it is clear for a skilled person that without deviating from the principles of the invention further embodiments of the OCV 10 fall under the scope of the invention, e.g. different placements of the check valve 40 in the housing 16 of the OCV.

In short, therefore, the invention can be described as relating to an oil flow control valve 10 for a cam phaser comprising a spool 18, a spool housing 16 and a check valve 40, wherein the spool 18 comprises a throughbore 60 and the check valve 40 is mounted in the spool housing 16 in that it extends through the throughbore 60 allowing the check valve 40 to be integrated in the housing 16 of the oil flow control valve 10, with the spool 18 reciprocally moving around the check valve 40, in order to avoid any influencing of the equilibrium of a spool 18 when the oil pressure is suddenly changing in the oil flow control valve 10 due to varying efforts in the cam phaser caused by the valve train.

The invention claimed is:

1. An oil flow control valve for a cam phaser comprising a spool, a spool housing and a check valve wherein the spool comprises a throughbore and the check valve is mounted in the spool housing in that the check valve extends through the throughbore.

2. An oil flow control valve according to claim 1, wherein the check valve comprises an elongated cage and a spring biased ball contained in the cage.

3. An oil flow control valve according to claim 2, wherein the cage is located near a middle-portion of the spool with the main axis of the cage and the main axis of the spool oriented perpendicular.

4. An oil flow control valve according to claim 1, wherein the throughbore is of elongated circular shape allowing reciprocating movement of the spool in the housing.

5. An oil flow control valve according to claim 1, wherein the oil flow control valve is fed from the side and the check valve is placed near a relevant inlet of the oil flow control valve.

6. An oil flow control valve according to claim 2, wherein the cage comprises at least one opening provided in order to allow oil to pass from inside the cage into the throughbore.

7. An oil flow control valve according to claim 1, wherein the check valve comprises two biasing springs and two balls spring biased by said biasing springs.

8. An oil flow control valve according to claim 7, wherein the two biasing springs are separated by a divider.

9. An oil flow control valve according to claim 1, wherein the main axis of the housing and the main axis of the spool are parallel and wherein the spool is disposed non-centrally in the housing.

* * * * *